US006358192B1

(12) United States Patent
Michalik

(10) Patent No.: US 6,358,192 B1
(45) Date of Patent: Mar. 19, 2002

(54) DEVICE FOR ADJUSTING FOLDING JAWS

(75) Inventor: Horst Bernhard Michalik, Höchberg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/403,028

(22) PCT Filed: Apr. 21, 1998

(86) PCT No.: PCT/DE98/01100

§ 371 Date: Oct. 21, 1999

§ 102(e) Date: Oct. 21, 1999

(87) PCT Pub. No.: WO98/47709

PCT Pub. Date: Oct. 29, 1998

(30) Foreign Application Priority Data

Apr. 21, 1997 (DE) ..... 197 16 626

(51) Int. Cl.[7] ..... B31F 1/08

(52) U.S. Cl. ..... 493/424; 493/475; 493/476

(58) Field of Search ..... 493/424, 442, 493/434, 444, 425, 426, 437, 475, 476

(56) References Cited

U.S. PATENT DOCUMENTS

| | | | | |
|---|---|---|---|---|
| 4,332,582 A | | | 6/1982 | Hertrich |
| 4,610,652 A | | | 9/1986 | Henn et al. |
| 5,057,064 A | | | 10/1991 | Michalik |
| 5,417,642 A | | * | 5/1995 | Boronka et al. |
| 5,507,714 A | | * | 4/1996 | Furuta et al. |
| 5,653,429 A | | * | 8/1997 | Michalik et al. |
| 5,860,342 A | | | 1/1999 | Hillebrand et al. |
| 5,937,757 A | | * | 8/1999 | Jackson et al. |
| 6,165,118 A | | * | 12/2000 | Eckert |

FOREIGN PATENT DOCUMENTS

| | | | |
|---|---|---|---|
| DE | 1057141 | | 5/1959 |
| DE | 1938644 | | 5/1968 |
| DE | 2103946 | | 8/1972 |
| DE | 2537919 | | 3/1977 |
| DE | 2755361 | A1 | 6/1978 |
| DE | 2537920 | B2 | 11/1978 |
| DE | 3838314 | A1 | 5/1990 |
| DE | 4143003 | A1 | 7/1993 |
| DE | 19533064 | A1 | 9/1996 |
| EP | 0095605 | A2 | 5/1983 |
| GB | 361416 | | 3/1930 |
| GB | 2081685 | * | 2/1982 |

* cited by examiner

*Primary Examiner*—Eugene Kim
(74) *Attorney, Agent, or Firm*—Jones, Tullar & Cooper, PC

(57) ABSTRACT

The clearance or gap between cooperating pairs of folding jaws in a folding jaw system is adjustable by using a roller and a control cam. The control cam has an axial width that is several times greater than the roller track. The control cam is inclined across its axial width and the control cam and roller are shiftable axially with respect to each other.

8 Claims, 3 Drawing Sheets

DEVICE FOR ADJUSTING FOLDING JAWS

FIELD OF THE INVENTION

The present invention relates to a device for adjusting the clamping gap between folding jaws. A roller is used to open and close the folding jaws. This roller rides on a control cam track of an axially movable control cam. Movement of the cam changes the clamping gap.

DESCRIPTION OF THE PRIOR ART

A folding jaw cylinder of a folding apparatus of rotary printing presses which uses cam-controlled folding jaw shafts and resilient counter-jaws, is known from DE-GM 19 38 644. In this device, the controlled folding jaw spindles and the resilient counter-jaws are arranged on two separate cylinder body elements, which are rotatable in relation to each other. For setting the product thickness, both cylinder body elements are adjusted in respect to each other against the force of a spring by means of a wedge element.

In connection with this prior art folding jaw cylinder it is disadvantageous that it is necessary to adjust two cylinder body elements, which are expensive to produce, with respect to each other.

DE-OS 2755 361, describes a folding jaw cylinder of a rotary printing press. Control cams of the folding jaw can be adjusted in the circumferential direction of the folding jaw cylinder for setting an opening time of the folding jaws, and in the axial direction for changing the mode of operation.

DE-OS 21 03 946, discloses a folding jaw cylinder, wherein the folding jaw shafts are synchronized by means of gear wheels.

EP 0 095 605 A2, shows a control for a folding jaw of a jaw cylinder in the folding apparatus of rotary printing presses. Here, the angular position between the folding jaw and the associated roller lever can be changed.

SUMMARY OF THE INVENTION

DE-OS 27 55 361 describes a folding jaw cylinder of a rotary printing press. Control cams of the folding jaws can be adjusted in the circumferential direction of the folding jaw cylinder for setting an opening time of the folding jaws, and in the axial direction for changing the mode of operation.

DE-OS 21 03 946 discloses a folding jaw cylinder, wherein the folding jaw shafts are synchronized by means of gear wheels.

EP 0 095 605 A2 shows a control for a folding jaw of a jaw cylinder in the folding apparatus of rotary printing presses. Here, the angular position between the folding jaw and the associated roller lever can be changed.

The object of the invention is based on providing a device for setting the clamping gaps between pairs of folding jaws of a folding jaw cylinder.

In accordance with the invention, this object is attained clamping gap by the same amount of the insertion of the folding blade. Since transverse folding takes place in two stages, pre-folding and finished folding, the forces respectively required for one folding step are reduced. The lateral faces of the pre-fold product, which are in contact with the pre-fold clamping gap are handled free of damage because of the employment of cylindrical pre-fold clamping elements of the pre-fold clamping system which are operating in a pincer-like manner. In the same way the finished folding of the pre-folded product of up to 192 pages takes place free of damage because of the employment of folding rollers.

By producing a device for adjusting the clamping gap between folding jaws in accordance with the present invention, the prior art arrangement of expensive cylinder body elements, which can be rotated in respect to each other, is avoided. The distance between folding jaws can be preset by means of a simple gear.

Moreover, the device of the present invention is also suitable for pre-setting pairs of pre-fold clamping elements located on a pre-fold cylinder.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENTS

Figure 1:
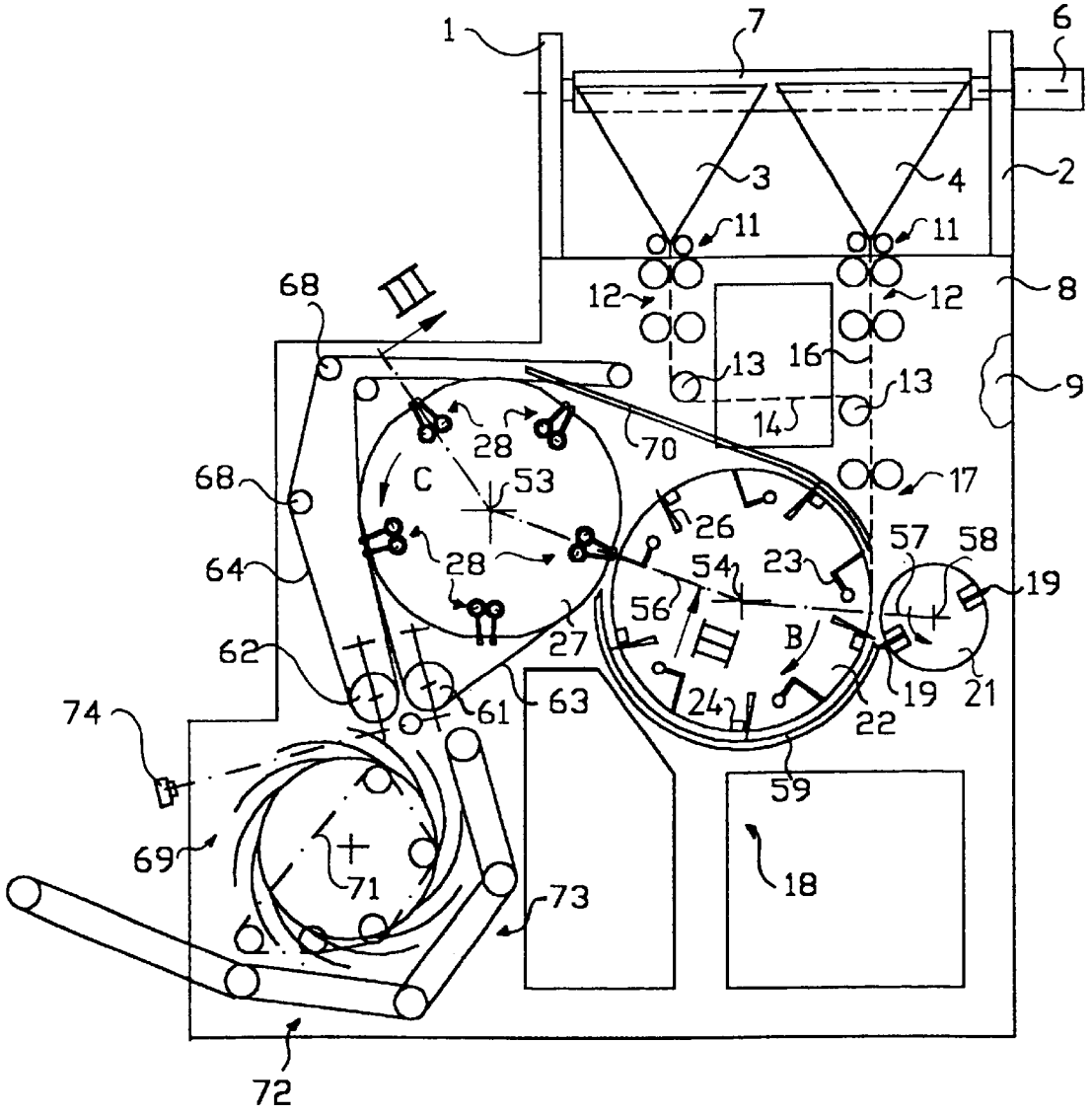
FIG. 1, a cross section through a schematic representation of a folding apparatus in accordance with the present invention.

Two longitudinal folding funnels hoppers 3, 4 are arranged between two lateral frames 1, 2, which have a funnel or hopper inlet roller 7, driven by a motor 6, on their paper inlet side, all as seen in FIG. 1. On their hopper outlet side respectively one pair of funnel or hopper folding rollers 11, located between lateral frames 8, 9, respectively one drawing roller group 12, as well as transfer rollers 13, are arranged. These conduct one or several paper ribbons 14, 16 via a main drawing roller group 17 to a transverse cutting and transverse folding device 18, also seated between the lateral frames 8, 9. The transverse cutting and transverse folding device 18 has a known, two-piece, i.e. provided with two cutters 19, cutting cylinder 21, which in turn, operates against a grooved strip and point spur cylinder 22, which is also called a five piece or field transport and folding blade cylinder. This cylinder 22 has, respectively arranged on its circumference, five folding blades and folding blade fixtures 23, grooved strips 24 and point spur systems 26.

Figure 2:
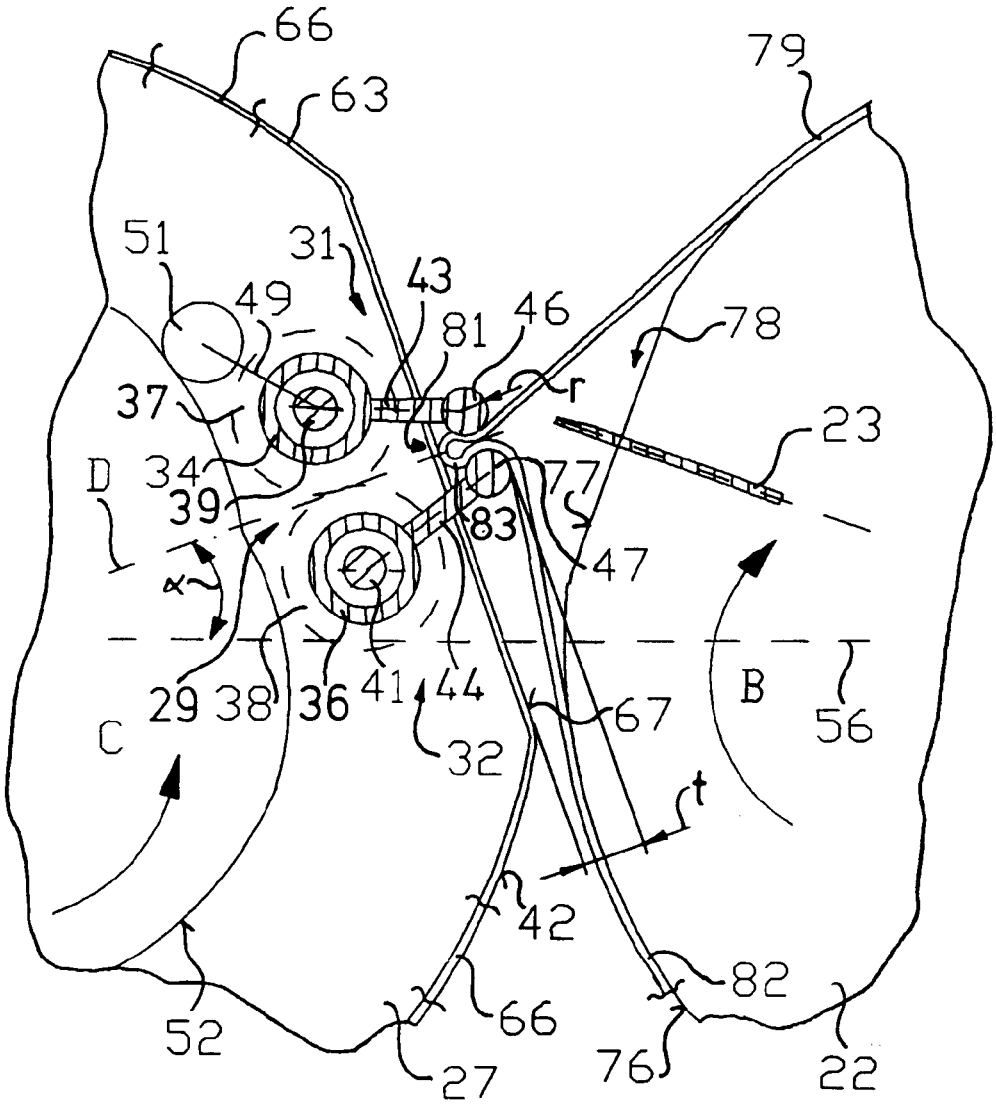
FIG. 2, a cross section through an enlarged schematic representation of a pre-fold clamping element which has just picked up a transversely-folded product; and in FIG. 3, a longitudinal section taken along line III—III in FIG. 1, wherein only one end of a pre-fold cylinder with a central control of the pre-fold clamping element system is represented.

The transverse cutting and transverse folding device 18 furthermore has a rotating body, for example a pre-fold cylinder 27, with a number n, for example three, five or seven, but preferably five, pre-fold clamping element systems 28, distributed at even distances over its circumference, which respectively work together with the folding blade fixtures 23 of the cylinder 22, all as may be seen in FIGS. 1 and 2.

Figure 3:
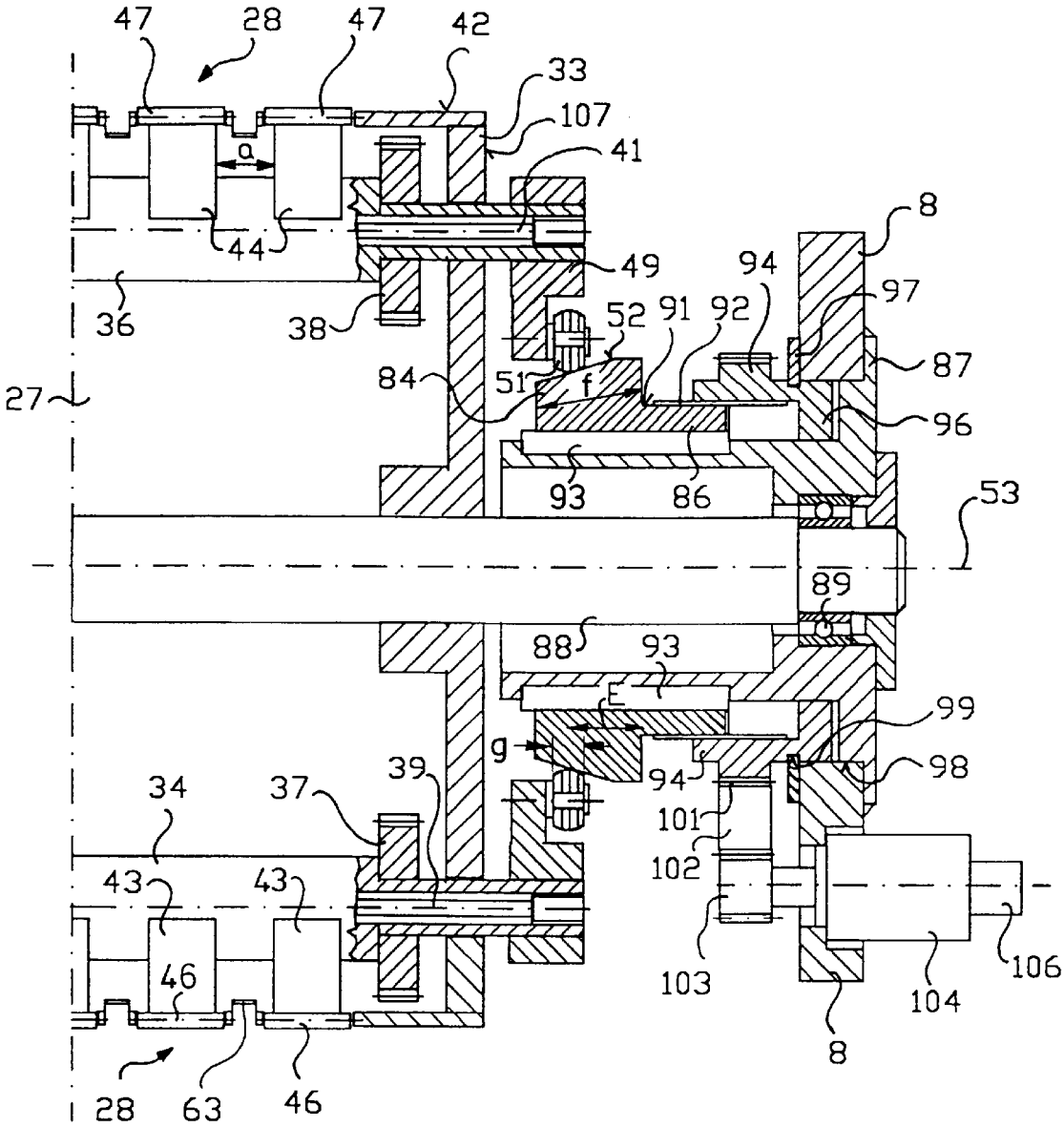

Each one of the pre-fold clamping element systems 28 consists of from a number m of two to ten pairs of folding-jaw-like pre-fold clamping elements 31, 32, which pairs of clamping elements 31, 32 are arranged in the axis-parallel direction of the pre-fold cylinder 27 next to each other and spaced apart from each other at a clear spacing distance "a", as shown in FIG. 3 and which operate in a jaw-like manner.

Between lateral or end walls 33 of the pre-fold cylinder 27—only one lateral wall 33 of pre-folded cylinder 27 being represented in FIG. 3—two shafts 34, 36, for example hollow shafts, are equipped with the pre-fold clamping elements 31, 32. The ends of the shafts 34, 36 are seated in the lateral walls 33 of the pre-fold cylinder 27 and are synchronized with each other by means of tooth segments 37, 38 fixed on the shaft, or by gear wheels. A torsion bar 39, 41 has been inserted into the center of the shaft 34, 36. Respectively, one end of the torsion bar 39, 41 is connected with the shaft 34, 36; the other end of the torsion bar 39, 41 is fixed in place in a clamping device, not specifically represented.

This clamping device for each torsion bar 39, 41 is located on the outside of the lateral wall, not represented, which lies opposite the lateral wall 33.

Each pre-fold clamping element 31, 32 is embodied with an enlargement at is end near the periphery, as well as on the side which enlargement or lobe is in contact with the pre-fold product as depicted in FIG. 2. For this purpose, the shaft 34 has finger-like, spring-elastic or resilient supports 43, oriented radially in the direction toward the periphery 42 of the pre-fold cylinder 27 and spaced apart from each other at a distance "a", as shown in FIG. 3. On its outer end, near the periphery 42 of the pre-fold cylinder, each support 43 has an enlargement or lobe 46, extending in the axis-parallel direction with respect to the axis of rotation of the pre-fold cylinder 27. This means that the end of the pre-fold clamping elements 31, 32, acting on the folded product projects radically outwardly in respect to the support 43.

In the same way, the respective second shaft 36 has spring elastic supports 44, each with a cylindrical enlargement or lobe 47. The supports 43, 44 with the enlargements or lobes 46, 47 respectively operate together as pairs 29 of pre-fold clamping elements.

It is also possible to design the supports 43, 44 and the associated enlargement 46, 47 in one piece.

These ends, provided with enlargements, can be used not only with pre-fold clamping elements 31, 32, but also generally in connection with folding jaws.

A control arm 49 is located on one of the shafts, for example the shaft 34, and is fixed against relative rotation on the shaft end which has the clamping point of the torsion bar 39 or 41. On its end remote from the torsion bar, the control arm 49 has a roller 51, which runs off on a known control cam track 52 of a control cam 84, which is fixed in place on the lateral frame 8, all as shown in FIG. 3.

This control cam track 52 has rises and depressions for generating a stroke for opening and closing the pre-fold clamping elements 31, 32.

Axes of rotation 53, 54 of the pre-fold cylinder 27, as well as of the folding blade, grooved strip and point spur cylinder 22 are spaced apart by means of an imagined center line 56, and the axis of rotation 54 is distanced by means of an imagined central line 57 from an axis of rotation 58 of the cutting cylinder 21. The folding blade cylinder 22 is surrounded below these central lines 56, 57 by paper guide rods 59, fixed in place on the lateral frame, as may be seen in FIG. 2.

Two folding rollers 61, 62 for finish-folding the printed products, which folding rollers 61, 62 are resiliently seated in respect to each other between the lateral frames 8, 9 and are also a part of the transverse cutting and transverse folding device 18, are arranged downstream of the pre-folding cylinder 27. The transport of pre-folded printed products between the pre-fold cylinder 27 and the folding rollers 61, 62 takes place by means of two cooperating belt systems 63, 64.

The belts of the first belt system 63 are guided on the circumference 42 of the pre-fold cylinder 27 in grooves 66 located between the pairs 29 of pre-fold clamping elements 31, 32, as well as on a portion of the circumference of the first folding roller 61. The pre-fold cylinder 27 has a secant-like surface portion 67 as seen in FIG. 2 compared to the periphery 42 of the remainder of cylinder 27, with this secant-like surface portion 67 extending in an axis-parallel direction, respectively a hose locations of the grooves 66 of the pre-fold cylinder 27 at which a pre-fold clamping element system 28 is located. Between the closed pairs 29 of the pre-fold clamping elements 31, 32 this secant-like surface 67 has a depth "t", which is greater than twice the radius r of the enlargements or lobes 46, 47 formed on the outer ends of the finger-like spring elastic supports 43, 44.

Also, respectively one secant-shaped surface 77, extending in an axis-parallel direction to the transport and folding blade cylinder 22, is provided on the axis of rotation of the circumference 76 of the transport and folding blade cylinder 22 at the place where folding blades 23 are arranged.

By means of belt guide rollers 68, the second belt system 64 is conducted above, and at the side of, the pre-fold cylinder 27, partially around the pre-fold cylinder 27, as well as around the second folding roller 62. Both belt systems 63, 64 act together.

The clear distance between the two folding rollers 61, 62 can be set in accordance with the thickness of the transversely folded product by means of a known folding roller gap adjustment device 74. Therefore, both folding rollers 61, 62 are resiliently seated against each other in a known way in order to temporarily compensate, without damage, a thickening of folding products, for example after the change and the connection of paper webs.

Paper guide rods 70, fixed in place in the lateral frames, are arranged above the cylinders 22, 27 between the entry of the paper ribbons 14, 16 and the second belt system 64.

A known paddle wheel 69 with a known ejection system 71 for printed products for depositing the transversely folded products on a delivery belt 72, is arranged below the folding rollers 61, 62 in the lateral frames 8, 9. A guide belt 73, located at the side of the paddle wheel 69 in the vertical direction, is arranged upstream of the delivery belt 72.

The opening width of the pairs 29 of pre-fold clamping elements 31, 32 can be adjusted by means of the shape of the control cam track 52.

For the purpose of setting the product thickness of the signatures 78 which are to be pre-folded, the control cam track 52 has a width "f", viewed in cross section in the axial direction, which corresponds to several times the width "g" of the roller track. In cross section, i.e. across a width of the control cam 84, the control cam track 52 has a rise, which increases in the direction toward the lateral frame 8. Accordingly, the control cam 84 is embodied in the shape of a truncated cone and is arranged to be displaceable in the axial direction E of the pre-fold cylinder 27. The control cam 84 has a centered bore and is laterally fastened on a sleeve-shaped control cam support 86, wherein an interior diameter of the centered bore and an interior diameter of the control cam support 86 are equal, and both elements 84, 86 are preferably made as one piece, as may be seen in FIG. 3.

The control cam support 86 is arranged coaxially with the control cam 84 on a bearing brushing 87, which is fixed in place on the lateral frame, and which, in turn, receives in its interior a shaft journal 88 of the pre-fold cylinder 27, seated in a roller bearing 89. On its surface 91, the sleeve-shaped portion of the control cam support 86 has an exterior thread 92 and is seated, fixed against relative rotation, axially displaceably on the control cam support 86 by means of a feather key 93, for example.

A sleeve 94 with an interior thread, which and is connected as one piece with a guide ring 96 on the side close to the lateral frame, is in engagement with the exterior thread 92 of the control cam support 86. The guide ring 96 is rotatably supported with its inner running surface on the surface 91 of the control cam support 86, and is secured against axial displacement, for example by means of a two-piece holding ring 97, which is fixed in place on the lateral frame and engages an annular groove 99 circumscribed in an outer surface 98.

On its outer surface 98, the sleeve 94 with the interior thread has teeth 101 which are connected, for example by means of a toothed belt 102, with a toothed disk 103 of a motor 104, fixed in place on the lateral frame, all as may be seen in FIG. 3. An angle encoder 106 is connected, fixed against relative rotation, with the motor 104.

If it is now intended to change the pre-fold clamping gap 81 because of the different thickness of another folded product, the sleeve 94 with the interior thread is rotated by means of the drive 104 to 101, so that, by means of this rotation of sleeve 94 the control cam support 86 is moved in the axial direction E. If the roller 51 now rides on the control cam track 52 in another, for example a higher, position than represented in FIG. 3, the width of the pre-fold clamping gap 81 is reduced.

Instead of the running surface of the control roller 51 being crowned, when viewed in cross section, it can also be designed in the form of a truncated cone and thus can adapt itself to the rise in the control cam track 52. In this case, the rise of the control cam track 52 corresponds to the amount of the stroke of the control roller 51.

With this it is also possible to adjust the width of folding jaws in folding jaw cylinders.

In accordance with a second preferred embodiment, the control cam track 52 can also be arranged fixed in place on the lateral frame, and the control arm 49 supporting the roller 51 can be adjustable in the axial direction on the spindle, or respectively the torsion bar 41. However, it is essential that the control cam track 52, which is inclined in respect to the axis of rotation 53 of the pre-fold cylinder 27, is arranged dispaceably in relation to the cam roller 51.

The cylinderical support roller is used as force support of the axial forces generated by the control cam.

A method for transversely folding signatures in accordance with the present invention progresses as follows:

Signatures 78 are cut from the paper ribbons 14, 16, which paper ribbons 14, 16 are conducted above each other, on the folding blade, grooved strip and point spur cylinder 22 with the cooperation of the cutting cylinder 21, and are respectively grasped at their front edge of a leading element 79 of the signature 78, pointing in the running direction B of the cylinder 22, by means of the point spur or other gripper system 26, and are conducted to a pre-fold clamping system 28 of the pre-fold cylinder 27. In the process, each signature 78, collected or uncollected, is pushed into a pre-fold clamping gap 81 of the pre-fold clamping element system 28 by means of a folding blade 23 located on the cylinder 22 as seen in FIG. 2. The leading element 79, as well as a trailing element 82 of the signature 78 is pushed into the pre-fold clamping gap 81 by the amount of the penetration depth of the folding blade 23. FIG. 2 shows a position D of the cylinders 22, 27, in which the pre-fold clamping elements 31, 32, as well as the folding blade 23 have already passed through the central line 56 by an angle of rotations $\alpha$. Following the retraction of the folding blade 23, as depicted in FIG. 2, the pre-fold clamping elements 31, 32 close pincer-like, or respectively jaw-like, and form a pre-fold 83 on the signature 78.

In the process, while the signature 78 is inserted into the pre-fold clamping gap 81, the point spurs of the point spur system 26 are pulled out of the leading element 79 of the signature 78 against the clockwise turning direction B of the transport and folding jaw cylinder 22 in a manner disclosed in DE 195 33 064 A1 which corresponds to U.S. Pat. No. 5,860,342

Because the enlargements or lobes 46, 47 of the supports 43, 44 are formed in a cylinder shape, the pre-fold 83 is formed as a bead or bulge on the other side of an imagined contact line of the two enlargements or lobes 46, 47 and radially inside the two pre-fold clamping elements 31, 32. For this reason, the pre-folded product 83, 79, 82 shaped in this way cannot slip out of the closed pre-fold clamping elements 31, 32 during the further transport on the pre-fold cylinder 27. Thus, With this it is also possible to adjust the width of folding jaws in folding jaw cylinders.

In accordance with a further embodiment variation, the control cam track 52 can also be arranged fixed in place on the lateral frame, and the control arm 49 supporting the roller 51 can be adjustable in the axial direction on the spindle, or respectively the torsion bar 41. However, it is essential that the control cam track 52, which is inclined in respect to the axis of rotation 53 of the pre-fold cylinder 27, is arranged displaceably in relation to the cam roller 51.

The cylindrical support roller is used as force support of the axial forces generated by the control cam. roll off over the rounded pre-fold clamping elements without jamming the pre-folded product in the process.

In order to prevent the point spurs from tearing during the folding process, during their return, the, point spurs are additionally moved back in respect to the front edge of the leading element of the signature by approximately the amount of the penetration depth of the folding blade into the pre-fold clamping gap.

While preferred embodiments of a device for adjusting folding blades in accordance with the present invention have been set forth fully and completely hereinabove, it will be apparent to one of skill in the art that a number of changes in, for example, the type of rotary printing press used, the drive assembly for the cylinders and the like could be made without departing from the true spirit and scope of the present invention which is accordingly to be limited only by the following claims.

What is claimed is:

1. A device for adjusting a clamping gap in a folding jaw system of a printing press, said device comprising:

a folding jaw cylinder, said folding jaw cylinder being rotatable about an axis of rotation;

at least one pair of folding jaws carried on said folding jaw cylinder;

a roller carried by said at least one pair of folding jaws, said roller opening and closing its associated pair of folding jaws on said folding jaw cylinder during rotation of said folding jaw cylinder about its axis of rotation;

a control cam having a cone shape defining a control cam track with a continuous surface, said control cam track surface having an axial width with said control cam track surface being inclined over said axial width in a direction of said axis of rotation of said folding jaw cylinder, said control cam track surface further having rises and depressions, said roller riding on said control cam track surface to generate movement of said roller for opening and closing its associated pair of said folding jaws on said folding jaw cylinder; and means for axially displacing said control cam and said roller with respect to each other in said direction of said axis of rotation of said folding jaw cylinder during operation of the printing press, said axial displacement of said control cam and said roller with respect to each other in said direction of said axis of rotation of said folding jaw cylinder changing an amount of said movement of said roller to adjust the clamping gap between said at least one pair of folding jaws whereby the clamping gap can be infinitely adjusted due to said cone shaped control cam track surface.

2. The device of claim 1 wherein said control cam is displaceable in said axial direction toward said folding jaw cylinder.

3. The device of claim 1 wherein said roller has a roller track width and further wherein said control cam track width is several times said roller track width.

4. The device of claim 1 further including a finish folder having finish folding jaws, said finish folder being located downstream, in a direction of web travel in the printing press from said folding jaw cylinder, said folding jaw cylinder operating as a pre-folding cylinder.

5. The device of claim 1 further including an axially displaceable, sleeve-shaped control cam support having an exterior threaded surface and being fixed against rotation, and an interiorly threaded rotatable sleeve, said sleeve being axially fixed and being rotatably supported on said control cam support, and further including means for rotating said interiorly threaded rotatable sleeve.

6. The device of claim 1 wherein said roller is displaceable in said axial direction.

7. The device of claim 1 wherein each said pair of folding jaws includes first and second folding jaws, said first and second folding jaws in each said pair of folding jaws being synchronized for opening and closing.

8. The device of claim 1 wherein said folding jaw cylinder is a one piece cylinder.

* * * * *